US007719512B2

(12) United States Patent
Kwon

(10) Patent No.: US 7,719,512 B2
(45) Date of Patent: May 18, 2010

(54) LIQUID CRYSTAL DISPLAY AND METHOD FOR DRIVING THE SAME

(75) Inventor: Kyung Joon Kwon, Seoul (KR)

(73) Assignee: LG Display Co., Ltd., Seoul (KR)

( * ) Notice: Subject to any disclaimer, the term of this patent is extended or adjusted under 35 U.S.C. 154(b) by 865 days.

(21) Appl. No.: 11/433,426

(22) Filed: May 15, 2006

(65) Prior Publication Data

US 2007/0002000 A1 Jan. 4, 2007

(30) Foreign Application Priority Data

Jun. 30, 2005 (KR) ..... 10-2005-0057792

(51) Int. Cl.
*G09G 3/36* (2006.01)

(52) U.S. Cl. ..... 345/102; 345/87

(58) Field of Classification Search ..... 345/87, 345/102

See application file for complete search history.

(56) References Cited

U.S. PATENT DOCUMENTS

2004/0257329 A1* 12/2004 Park et al. ..... 345/102
2005/0248592 A1* 11/2005 Feng et al. ..... 345/690
2006/0007111 A1* 1/2006 Moon et al. ..... 345/102

* cited by examiner

*Primary Examiner*—Amare Mengistu
*Assistant Examiner*—Insa Sadio
(74) *Attorney, Agent, or Firm*—Birch, Stewart, Kolasch & Birch, LLP

(57) ABSTRACT

A liquid crystal display (LCD) and corresponding driving method. The LCD includes a liquid crystal display panel for displaying images, a gate driver and a source driver for supplying scan signals and analog pixel signals to gate and data lines of the liquid crystal panel, a backlight unit having a side radiation type LED array that is driven sectionally by a plurality of unit areas to irradiate light to the liquid crystal display panel, and a luminance controller for controlling a luminance of the LED array by unit areas according to surrounding units areas.

14 Claims, 8 Drawing Sheets

| | |
|---|---|
| 66.78% (SA) | 9.83% (CA_W) |
| 15.59% (CA_L) | 7.8% (CA_D) |

Fig. 8

| | | |
|---|---|---|
| 20 (CA_D) | 57 (CA_L) | 20 (CA_D) |
| 27 (CA_W) | 216 (SA) | 27 (CA_W) |
| 20 (CA_D) | 57 (CA_L) | 20 (CA_D) |

Fig. 9

| | | |
|---|---|---|
| 4.31% (CA_D) | 12.28% (CA_L) | 4.31% (CA_D) |
| 5.82% (CA_W) | 46.55% (SA) | 5.82% (CA_W) |
| 4.31% (CA_D) | 12.28% (CA_L) | 4.31% (CA_D) |

Fig. 10

| | | | | |
|---|---|---|---|---|
| (UA1) | (UA2) | (UA3) | (UA4) | (UA5) |
| (UA6) | (UA7) | (UA8) | (UA9) | (UA10) |
| (UA11) | (UA12) | (UA13) | (UA14) | (UA15) |
| (UA16) | (UA17) | (UA18) | (UA19) | (UA20) |

LIQUID CRYSTAL DISPLAY AND METHOD FOR DRIVING THE SAME

This non-provisional application claims priority under 35 U.S.C. §119 (a) on Patent Application No. 10-2005-0057792 filed in the Republic of Korea on Jun. 30, 2005, the entire contents of which are hereby incorporated by reference.

BACKGROUND OF THE INVENTION

1. Field of the Invention

The present invention relates to a liquid crystal display (LCD) and its driving method, and more particularly to an LCD that comprises a side radiation type light emitting diode (LED) and corresponding driving method.

2. Description of the Related Art

An LCD is a display apparatus including a liquid crystal material with an anisotropic dielectric constant injected between upper and lower transparent insulation substrates. Further, a common electrode, a color filter and a black matrix are formed on the upper substrate, and a switching element and a pixel electrode are formed on the lower substrate. In addition, a strength of an electric field formed in the liquid crystal material is controlled by applying a different potential to the pixel electrode and the common electrode to change an alignment of molecules of the liquid crystal material to thus control an amount of light transmitted through the transparent insulation substrates, thereby displaying desired images. In addition, a thin film transistor (TFT) LCD using TFTs as switching elements is commonly used.

Further, because the LCD is a light receiving type display apparatus that does not emit light by itself, a back light unit (BLU) for uniformly sustaining a brightness of an overall screen is installed at a rear surface of the LCD panel. A BLU includes a light emitting diode array and has either a top radiation type LED or a side radiation type LED.

In addition, the BLU using the side radiation type LED has an advantage in terms of panel uniformity and color mixing of the liquid crystal display panel. However, the side radiation type LED has a problem because the light is spread to cover a large area, and thus it is not suitable to be used for sectional driving (division driving) for which light irradiation is controlled at each unit area (UA) of the LCD panel.

SUMMARY OF THE INVENTION

Accordingly, one object of the present invention is to provide an LCD that enhances the efficiency of sectional driving and the contrast ratio by dimming an LED array that belongs to a single reference unit area in consideration of a luminance of adjacent unit areas that surround the reference unit area in sectionally driving the BLU having the side radiation type LED array.

Another object of the present invention is to provide a method for effectively driving an LCD.

To achieve these and other objects in accordance with one aspect, the present invention provides a liquid crystal display including a liquid crystal display panel, a gate driver, a source driver, a timing controller, a back light unit (BLU), and a luminance controller. In addition, the liquid crystal display panel includes a plurality of gate and data lines arranged to cross each other, and a thin film transistor and a pixel electrode disposed at each crossing of the gate and data lines. Further, an image is displayed on the liquid crystal display panel according to scan signals supplied through the gate lines and analog pixel signals supplied through the data lines. The gate driver sequentially supplies the scan signals to the gate lines of the liquid crystal display panel and the source driver converts inputted pixel data into analog pixel signals and supplies the signals to the data lines of the liquid crystal display panel.

Further, the timing controller supplies a timing control signal to the gate driver and the source driver and supplies the pixel data to the source driver. The BLU includes a side radiation type LED array and is sectionally driven by a plurality of unit areas to irradiate light to the liquid crystal display panel. Further, the luminance controller receives the pixel data from the source driver, and controls a luminance of the LED array by unit areas according to the pixel data. In this instance, the luminance controller controls the luminance of the LED array using a luminance contribution percentage, namely, a ratio in which a luminance of adjacent unit areas that surround the reference unit area affects that of the reference unit area.

In addition, the luminance controller detects the brightest unit area among the reference unit area and the adjacent unit areas using the pixel data, and if the reference unit area is the brightest area, the luminance controller controls the reference unit area to have an average luminance of pixel data corresponding to the reference unit area, whereas if one or more of the adjacent unit areas is/are brighter than the reference unit area, the luminance controller calculates a correction luminance using a substantial luminance percentage, namely, a ratio in which the luminance of the reference unit area is changed by the luminance of the adjacent unit areas and the luminance contribution percentage of the adjacent unit areas, and controls the reference unit area to have the calculated correction luminance.

Further, the correction luminance of the reference unit area is determined depending on each position and the number of the adjacent unit areas. The correction luminance of the reference unit area is a value (D) obtained by dividing the sum (C) of a value (A), which is obtained by multiplying the average luminance and the substantial luminance percentage of the reference unit area, and a value (B), which is obtained by multiplying an average luminance and the luminance contribution percentage of the adjacent unit areas, by the number of the adjacent unit areas (that is, C=A+B, and D=C÷the number of adjacent unit areas).

Also, the substantial luminance percentage of the reference unit area is obtained such that when the average luminance of the reference unit area is controlled to have a first luminance value and the average luminance of the adjacent unit areas is controlled to have a second luminance value, an extent that the average luminance of the reference unit area is changed is measured to be determined as the luminance contribution proportions of the adjacent unit areas, and the ratio of the first luminance value to the sum of the first luminance value and the total obtained by adding up the luminance contribution proportions of the adjacent unit areas is expressed as the percentage.

Moreover, the luminance contribution percentage of the adjacent unit areas is obtained such that when the average luminance of the reference unit area is controlled to have the first luminance value and the average luminance of the adjacent unit areas is controlled to have the second luminance value, an extent that the average luminance of the reference unit area is changed is measured to be determined as the luminance contribution proportions of the adjacent unit areas, and the luminance contribution proportions of the adjacent unit areas to the sum of the first luminance value and the total obtained by adding up the luminance variation proportions of the adjacent unit areas are expressed as the percentage.

In another aspect, the present invention provides a liquid crystal display including a liquid crystal display panel, a gate driver, a source driver, a backlight unit (BLU), and a luminance controller. Further, the liquid crystal display panel includes a plurality of gate and data lines arranged to cross each other, and a thin film transistor and a pixel electrode disposed at each crossing of the gate lines and data lines. In addition, and an image is displayed on the liquid crystal display panel according to scan signals supplied through the gate lines and analog pixel signals supplied through the data lines. The gate driver sequentially supplies the scan signals to the gate lines of the liquid crystal display panel, and the source driver converts inputted pixel data into analog pixel signals and supplies the signals to the data lines of the liquid crystal display panel. Further, the timing controller supplies a timing control signal to the gate driver and the source driver and supplies the pixel data to the luminance controller and the source driver. The BLU includes a side radiation type LED array and is sectionally driven by a plurality of unit areas to irradiate light to the liquid crystal display panel. Also, the luminance controller receives the pixel data from the timing controller, and controls a luminance of the LED array by unit areas according to the pixel data. In this instance, the luminance controller controls the luminance of the LED array using a luminance contribution percentage, namely, a ratio in which a luminance of adjacent unit areas that surround the reference unit area affects that of the reference unit area.

Yet another aspect of the present invention provides a method for driving an LCD, which includes supplying, by a timing controller, a timing control signal to a gate driver and a source driver and pixel data to the source driver; sequentially supplying, by the gate driver, scan signals to gate lines of a liquid crystal display panel; converting, by the source driver, the pixel data into analog pixel signals and outputting the signals to data lines of the liquid crystal display panel; receiving, by a luminance controller, the pixel data from the source driver and controlling a side radiation type light emitting diode (LED) array provided in a backlight unit (BLU) by unit areas according to the pixel data; and irradiating light to the liquid crystal display panel by sectionally driving the BLU which is divided into a plurality of unit areas. Further, the luminance controller controls the luminance of the LED array using a luminance contribution percentage, namely, a ratio in which a luminance of adjacent unit areas that surround the reference unit area affects that of the reference unit area.

Still another aspect of the present invention provides a method for driving a liquid crystal display (LCD) including supplying, by a timing controller, a timing control signal to a gate driver and a source driver and pixel data to a luminance controller and the source driver; sequentially supplying, by the gate driver, scan signals to gate lines of a liquid crystal display panel; converting, by the source driver, the pixel data into analog pixel signals and outputting the signals to data lines of the liquid crystal display panel; receiving, by a luminance controller, the pixel data from the timing controller and controlling a side radiation type light emitting diode (LED) array provided in a backlight unit (BLU) by unit areas according to the pixel data; and irradiating light to the liquid crystal display panel by sectionally driving the BLU which is divided into a plurality of unit areas. Further, the luminance controller controls the luminance of the LED array using a luminance contribution percentage, namely, a ratio in which a luminance of adjacent unit areas that surround the reference unit area affects that of the reference unit area.

It should also be understood that the above-described embodiments are not limited by any of the details of the foregoing description, and any other embodiments that have not been mentioned would be clearly understood by those who have ordinary skills in the art to which the present invention pertains from the following descriptions.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIG. 8 is a table showing a luminance contribution proportion of each unit area in FIG. 7;

FIG. 9 is a table showing a luminance contribution percentage of each unit area in FIG. 7;

FIG. 10 is a table showing types of unit areas according to one embodiment of the present invention.

DETAILED DESCRIPTION OF THE PREFERRED EMBODIMENTS

Figure 1:
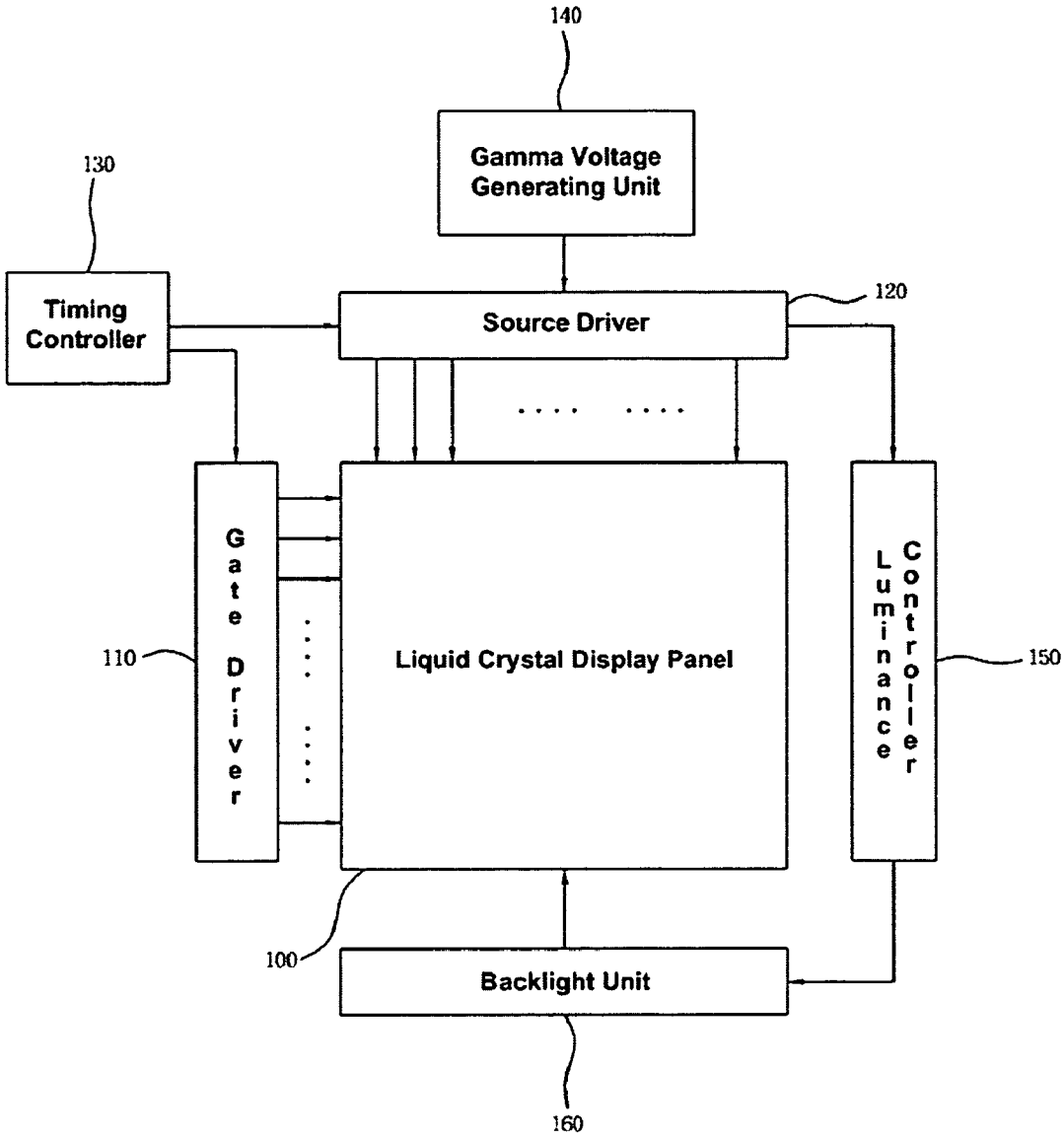
FIG. 1 is a block diagram showing an LCD according to one embodiment of the present invention.

Details of other embodiments of the present invention are included in the detailed description and drawings. The advantages, features and methods for achieving them will become more apparent from the following detailed description of the present invention when taken in conjunction with the accompanying drawings. Like reference numerals designate like elements throughout the specification.

The LCD and its driving method according to embodiments of the present invention will now be described in detail with reference to the accompanying drawings.

Figure 2:
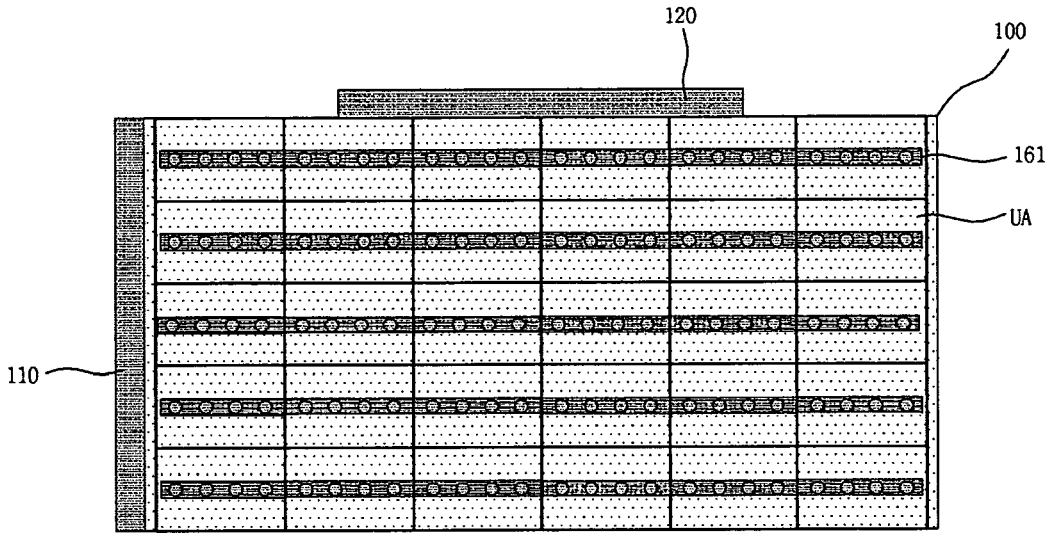
FIG. 2 is a detailed view showing a backlight unit (BLU) in FIG. 1.

With reference to FIGS. 1 and 2, the LCD according to one embodiment of the present invention includes an LCD panel 100, a gate driver 110, a source driver 120, a timing controller 130, a gamma voltage generating unit 140, a luminance controller 150, and a backlight unit 160. Further, the LCD panel 100 includes a plurality of gate and data lines arranged to cross each other. Also, a thin film transistor and a pixel electrode are disposed at each crossing of the gate and data lines, such that when scan signals are supplied through the gate lines and analog pixel signals are supplied through the data lines, images are displayed on the LCD panel 100.

In addition, the gate driver 110 sequentially supplies scan signals to the gate lines of the LCD panel 100, and the source driver 120 converts inputted pixel data into gamma voltages, namely, analog pixel signals, and supplies the gamma voltages to the data lines of the liquid crystal display panel 100. The pixel data is digital signals representing gray levels set to have values within the range of 0 to 255, and the source driver 120 converts the pixel data using the gamma voltages of plural levels supplied from the gamma voltage generating unit 140.

Further, the timing controller 130 supplies a timing control signal to the gate driver 110 and the source driver 120, and also supplies the pixel data together with the timing control signal to the source driver 120. Also, the gamma voltage generating unit 140 generates suitable gamma voltages of plural levels according to transmission rate-voltage characteristics of the LCD panel 100 using a resistor group including a plurality of resistors arranged in series. The gamma voltages are controlled to have accurate and uniform values so that the LCD panel 100 can maintain a stable display quality when displaying images.

Figure 3:
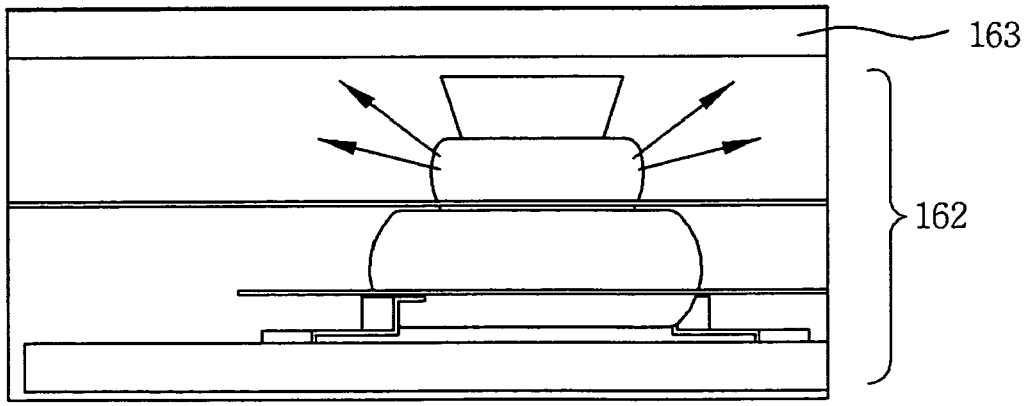
FIG. 3 is a detailed view showing a light emitting diode (LED) of the BLU in FIG. 2.

In addition, the BLU 160, which as shown in FIG. 2 includes an LED array 161, is installed on a rear surface of the LCD panel 100 and is divided into a plurality of unit areas (UA) so as to be sectionally driven to thereby irradiate light onto the LCD panel 100. Further, the LED array 161 includes a plurality of side radiation type LEDs 162 as shown in FIG. 3. Also, the LEDs 162 belonging to each UA are controlled to be simultaneously turned on or off to thereby sectionally drive the BLU 160 by UAs. In addition, whether to turn on or off the LEDs 162 or set a luminance (brightness) of the LEDs 162 in the range of 0% to 100% is controlled according to a dimming operation of the luminance controller 150. Three wavelength diodes of red, green and blue colors are used to implement various colors and increase the impression of colors.

Further, the luminance controller 150 receives the pixel data from the source driver 120 and mechanically or electronically controls a current according to the received pixel data to adjust a luminance of the LED array 161 by UAs. Namely, when an arbitrary UA is set as a reference UA, the luminance controller 150 detects pixel data of the reference UA and dims the LEDs 162 belonging to the reference UA according to the pixel data.

In addition, because the LEDs 162 are side radiation type LEDs 162, light spreads largely to the side and a portion of light emitted upward also collides with and is reflected from a diverter 163 (see FIG. 3). Thus, the amount of light contributed by the LEDs 162 belonging to the arbitrary UA to the corresponding UA is relatively small compared with a top radiation type LED and luminance of the reference UA is affected by adjacent UAs.

To solve this problem, the luminance controller 150 controls a luminance of the LED array 161 using a luminance contribution percentage, namely, the percentage in which a luminance of the adjacent UAs that surround the reference UA affects the luminance of the reference UA. In more detail, the luminance controller 150 detects the brightest UA among the reference UA and the adjacent UAs, and if the reference UA is the brightest UA, the luminance controller 150 controls the reference UA to have an average luminance of pixel data corresponding to the reference UA.

If, however, one or more of the adjacent UAs are brighter than the reference UA, a correction luminance is calculated using a substantial luminance percentage, namely, the percentage in which the luminance of the reference UA is changed by the luminance of the adjacent UAs and the luminance contribution percentage of the adjacent UAs, and the reference UA is controlled to have the calculated correction luminance. Further, in sectionally driving the BLU 160, a value of the average luminance of the reference UA and a value of the correction luminance that reflects the luminance contribution percentage of the adjacent UAs are compared and a greater value is determined as a dimming level of each UA constituting the BLU 160.

In this manner, the luminance controller 150 serves as a rating mask so that, in a perceptional view point, UAs adjacent to a bright UA are turned on to be brighter in consideration of an influence of the bright UA, and thus, a boundary that may be generated due to the sectional driving of the BLU 160 is weakened.

Figure 4:
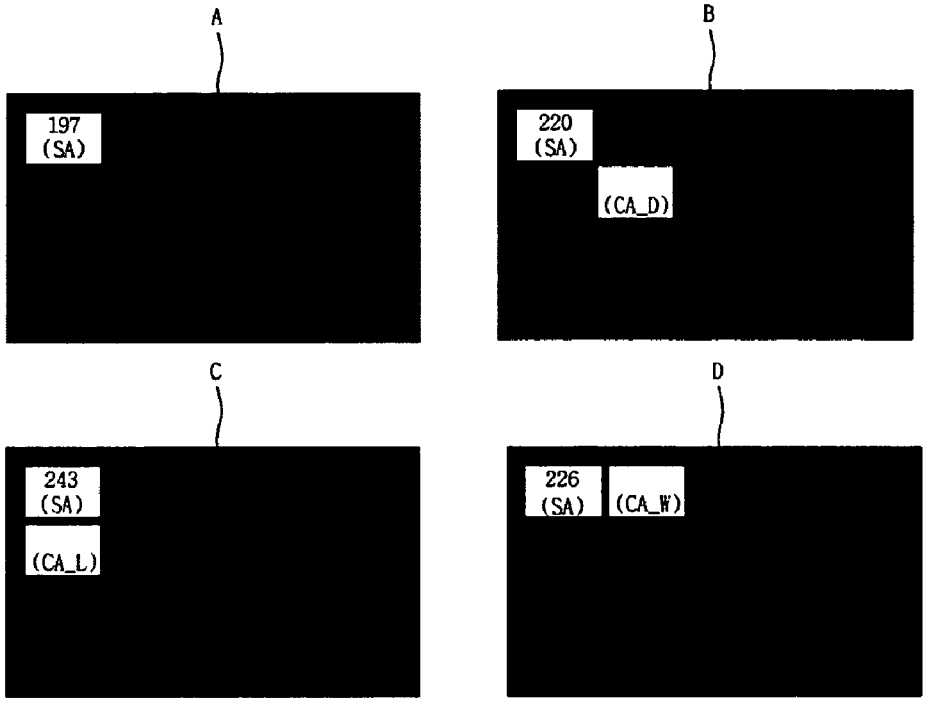
FIG. 4 is a reference view for explaining a luminance contribution proportion of each unit area according to one embodiment of the present invention.

Turning next to FIG. 4, which is a reference view for explaining a luminance contribution proportion of each unit area according to one embodiment of the present invention. With reference to FIG. 4, when the BLU 160 is sectionally driven by UAs to measure the luminance contribution proportion, each screen (A to D) indicates an image display state of the liquid crystal display panel 100 and an average luminance measured in each UA by the unit of nit (nit=cd/$m^2$).

In more detail, the reference screen (A) indicates an average luminance measured by driving only the LEDs 162 that belong to the reference UA (SA). The first to third luminance contribution proportion comparison screens (B, C and D) indicate an average luminance of the reference UA (SA) obtained by driving adjacent UAs (CA_D, CA_L, and CA_W) in diagonal, vertical and horizontal directions that surround the reference UA (SA), respectively, together with the reference UA (SA).

For example, as shown in FIG. 4, when the average luminance of the reference UA (SA) is measured to be 197 nit when only the LEDs 162 that belong to the reference UA (SA) are driven, if the diagonal, vertical and horizontal adjacent UAs (CA_D, CA_L, and CA_W) are driven to have a certain luminance value, the average luminance of the reference UA (SA) is changed to 220 nits, 243 nits, and 226 nits, respectively.

Figure 5:
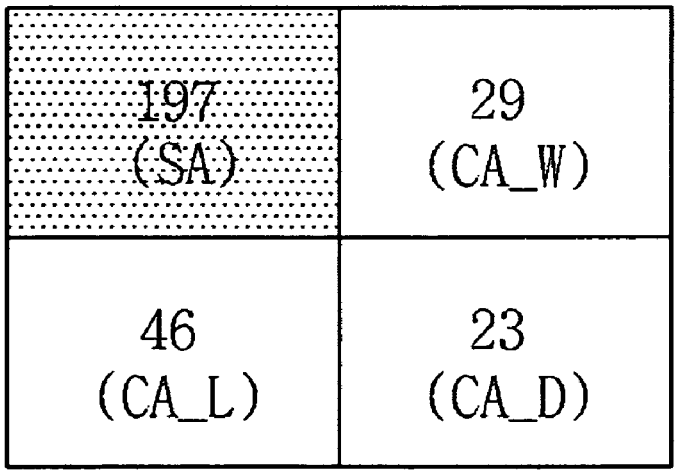
FIG. 5 is a table showing a luminance contribution proportion of each unit area in FIG. 4.

Thus, in this manner, the average luminance of the reference UA (SA) is changed depending on whether the adjacent UAs (CA_D, CA_L, and CA_W) are driven or not. For example, FIG. 5 shows a table of the average luminance of the reference UA (SA) and each luminance contribution proportion of the adjacent UAs (CA_D, CA_L, and CA_W) to the reference UA (SA).

Figures 6, 7:
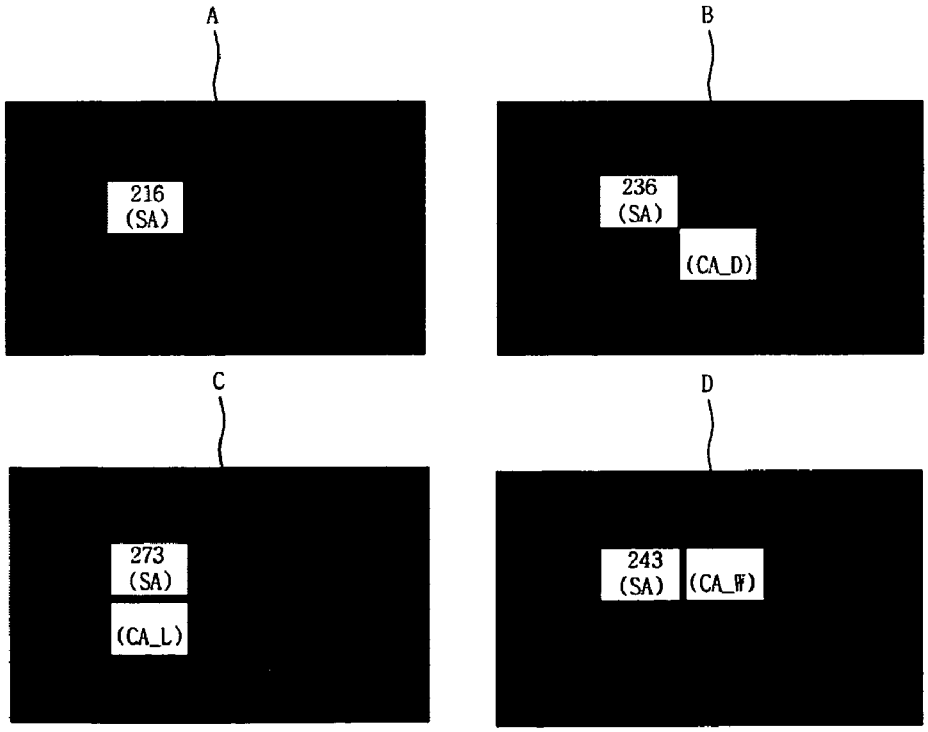
FIG. 6 is a table showing a luminance contribution percentage of each unit area in FIG. 4.
FIG. 7 is a reference view for explaining a luminance contribution proportion of each unit area according to another embodiment of the present invention.

Further, the average luminance of the reference UA (SA) is 197 nits, and as the diagonally, vertically and horizontally adjacent UAs (CA_D, CA_L, and CA_W) are driven, the average luminance of the reference UA (SA) is changed to 220 nits, 243 nits, and 226 nits. Accordingly, each luminance contribution proportion is calculated as 23 nits (220-197), 46 nits (243-197), and 29 nits (226-197). FIG. 6 shows each luminance contribution percentage for determining whether to apply a correction luminance to the reference UA (SA) and a correction luminance calculated based on the results of FIG. 5.

In addition, the substantial luminance percentage of the reference UA (SA) and each luminance contribution percentage of the adjacent UAs (CA_D, CA_L, and CA_W) as shown in FIG. 6 are calculated based on the average luminance of the reference UA (SA) and the luminance contribution proportions of the adjacent UAs (CA_D, CA_L, and CA_W) as follows. That is, because the average luminance of the reference UA (SA) is 197 nits and the luminance contribution proportions of the diagonally, vertically and horizontally adjacent UAs are 23, 46, and 29, respectively, the substantial luminance percentage of the reference UA (SA) is calculated as 66.78%[{197/(197+23+46+29)}*100] while the luminance contribution percentages of the respective adjacent UAs (CA_D, CA_L, and CA_W) are calculated as: 7.8%[{23/(197+23+46+29)}*100], 15.59%[{46/(197+23+46+29)}*100] and 9.83%[29/(197+23+46+29)], respectively.

In addition, the correction luminance of the reference UA (SA) can be calculated using the substantial luminance percentage of the reference UA (SA) and the luminance contribution percentages of the adjacent UAs (CA_D, CA_L, and CA_W) as '(197*0.6678+29*0.0983+46*0.1559+23*0.078/4'. Further, in generalizing the cases shown in FIGS. 4 to 6, preferably, the substantial luminance percentage of the reference UA (SA), the luminance contribution percentages of the adjacent UAs (CA_D, CA_L, and CA_W), and the correction luminance of the reference UA (SA) can be determined as follows.

The substantial luminance percentage of the reference UA is obtained such that when the average luminance of the reference UA is controlled to have a first luminance value and the average luminance of the adjacent UAs (CA_D, CA_L, and CA_W) is controlled to have a second luminance value, an extent that the average luminance of the reference UA is changed is measured to be determined as the luminance contribution proportions of the adjacent UAs (CA_D, CA_L, and CA_W). Further, the ratio of the first luminance value to the sum of the first luminance value and the total obtained by adding up the luminance contribution proportions of the adjacent UAs (CA_D, CA_L, and CA_W) is expressed as the percentage.

In addition, the luminance contribution percentages of the adjacent UAs (CA_D, CA_L, and CA_W) are obtained such that when the average luminance of the reference unit area is controlled to have the first luminance value and the average luminance of the adjacent UAs (CA_D, CA_L, and CA_W) is controlled to have the second luminance value, an extent that the average luminance of the reference unit area is changed is measured to be determined as the luminance contribution proportions of the adjacent UAs (CA_D, CA_L, and CA_W), and the luminance contribution proportions of the adjacent UAs (CA_D, CA_L, and CA_W) to the sum of the first luminance value and the total obtained by adding up the luminance variation proportions of the adjacent UAs (CA_D, CA_L, and CA_W) are expressed as the percentage.

The correction luminance of the reference UA is also obtained by dividing the sum of a value, which is obtained by multiplying the average luminance and the substantial luminance percentage of the reference UA, and a value, which is obtained by multiplying the average luminance and each luminance contribution percentage of the adjacent UAs (CA_D, CA_L, and CA_W), by the number of the adjacent UAs (CA_D, CA_L, and CA_W).

Turning next to FIG. 7, which illustrates the instance that when only the LEDs 162 that belong to the reference UA (SA) are driven, the average luminance of the reference UA (SA) is 216 nits, and as the LEDs 162 that belong to the diagonally, vertically and horizontally adjacent UAs (CA_D, CA_L, and CA_W) are driven to have a certain luminance value, the average luminance of the reference UA (SA) is changed to 236 nits, 273 nits, and 243 nits, respectively. Further, the average luminance and the substantial luminance percentage of the reference UA (SA) as shown in FIG. 9 are calculated based on the average luminance of the reference UA (SA) and the luminance contribution proportions of the respective adjacent UAs (CA_D, CA_L, and CA_W) as shown in FIG. 8.

In addition, the correction luminance of the reference UA (SA) is calculated as (20*0.0431*4+57*0.1228*2+27*0.0582*2+216*0.4655)/9 using the average luminance and the substantial luminance percentage of the reference UA (SA) and each luminance contribution percentage of the adjacent UAs (CA_D, CA_L, and CA_W).

As noted in FIGS. 4 to 9, preferably, the correction luminance of the reference UA (SA) is determined according to the positions and number of the adjacent UAs (CA_D, CA_L, and CA_W). Namely, the positions and number of the adjacent UAs (CA_D, CA_L, and CA_W) are changed depending on where the reference UA (SA) is positioned. For example, if the reference UA (SA) is at an edge portion of the LCD panel 100 as shown in FIGS. 4 to 6, the number of adjacent UAs (CA_D, CA_L, and CA_W) is 4, whereas if the reference UA (SA) is not on the edge portion of the liquid crystal display panel 100 as shown in FIGS. 7 to 9, the number of adjacent UAs (CA_D, CA_L, and CA_W) used for calculating the corresponding luminance is 9.

Next, FIG. 10 is a table showing types of UAs according to one embodiment of the present invention, in which the number of adjacent UAs is different when calculating the correction luminance according to a position of the reference UA. In more detail, the reference UAs can be divided into a type of reference UAs (UA1, UA5, UA16, and UA20) that have one horizontally adjacent UA, one vertically adjacent UA, and one diagonally adjacent UA, a type of reference UAs (UA2, UA3, UA4, UA17, UA18, and UA19) that have two horizontally adjacent UAs, one vertically adjacent UA, and two diagonally adjacent UA, a type of reference UAs (UA6, UA10, UA11, and UA15) that have one horizontally adjacent UA, two vertically adjacent UAs, and two diagonally adjacent UAs, and a type of reference UAs (UA7, UA8, UA9, UA12, UA13, and UA14) that have two horizontally adjacent UAs, two vertically adjacent UAs, and four diagonally adjacent UAs.

Figure 11:
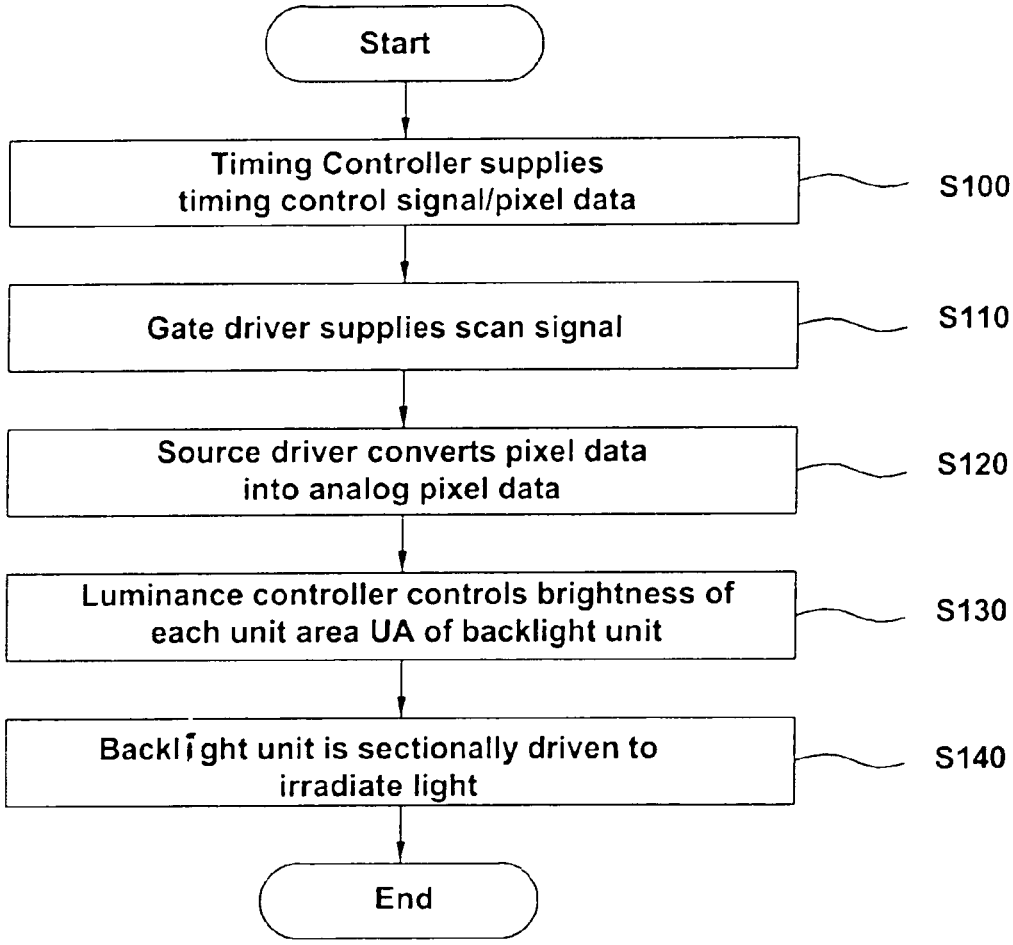
FIG. 11 is a flowchart illustrating a method for driving an LCD according to one embodiment of the present invention.

Turning now to FIG. 11, which is a flowchart illustrating a method for driving the LCD according to one embodiment of the present invention. FIG. 1 will also be referred to in this description.

First, as shown in FIG. 11, in the step S100, the timing controller 130 supplies timing control signals to the gate driver 110 and the source driver 120, and supplies pixel data to the source driver 120.

In the step S110, the gate driver 110 sequentially supplies scan signals to the gate lines of the liquid crystal display panel 110. In the step S120, the source driver 120 converts the pixel data into analog pixel signals and outputs the signals to the data lines of the LCD panel 100. Further, in the step S130, the luminance controller 150 receives the pixel data from the source driver, and controls a luminance of the side radiation type LED array 161 provided in the BLU 160 by the UAs according to the pixel data. The luminance of the LED array 161 is controlled using the luminance contribution percentage, namely, the ratio in which the luminance of the adjacent UAs that surround the reference UAs affects that of the reference UA.

Further, the luminance controller 150 detects the brightest UA among the reference UA and the adjacent UAs using the pixel data, and if the reference UA is the brightest area, the luminance controller 150 controls the reference UA to have an average luminance of corresponding pixel data. Meanwhile, if one or more of the adjacent UAs is/are brighter than the reference UA, the luminance controller calculates the correction luminance using the substantial luminance percentage of the reference UA and each luminance contribution percentage of the adjacent UAs and controls the reference UA to have the calculated correction luminance. In the step S140, the BLU 160 is sectionally driven by the plurality of UAs to irradiate light to the LCD panel 100.

Preferably, the correction luminance of the reference UA, the substantial luminance percentage of the reference UA, and each luminance contribution percentage of the adjacent UAs are calculated as follows. In more detail, the correction luminance of the reference UA is determined according to the positions and number of adjacent UAs, and preferably the correction luminance is calculated such that a value obtained by multiplying the average luminance and the substantial luminance percentage of the reference UA and a value obtained by multiplying the average luminance and the luminance contribution percentages of the respective adjacent UAs are added, and the sum is divided by the number of adjacent UAs to thereby obtain the correction luminance.

Herein, the substantial luminance percentage of the reference unit area is obtained such that when the average luminance of the reference unit area is controlled to have a first luminance value and the average luminance of the adjacent unit areas is controlled to have a second luminance value, the extent that the average luminance of the reference unit area is changed is measured to be determined as the luminance contribution proportions of the adjacent unit areas, and the ratio of the first luminance value to the sum of the first luminance value and the total obtained by adding up the luminance contribution proportions of the adjacent unit areas is expressed as the percentage.

Also, the luminance contribution percentages of the adjacent unit areas are obtained such that when the average luminance of the reference unit area is controlled to have the first luminance value and the average luminance of the adjacent unit areas is controlled to have the second luminance value, the extent that the average luminance of the reference unit area is changed is measured to be determined as the luminance contribution proportions of the adjacent unit areas, and the luminance contribution proportions of the adjacent unit areas to the sum of the first luminance value and the total obtained by adding up the luminance variation proportions of the adjacent unit areas are expressed as the percentage.

Figure 12:
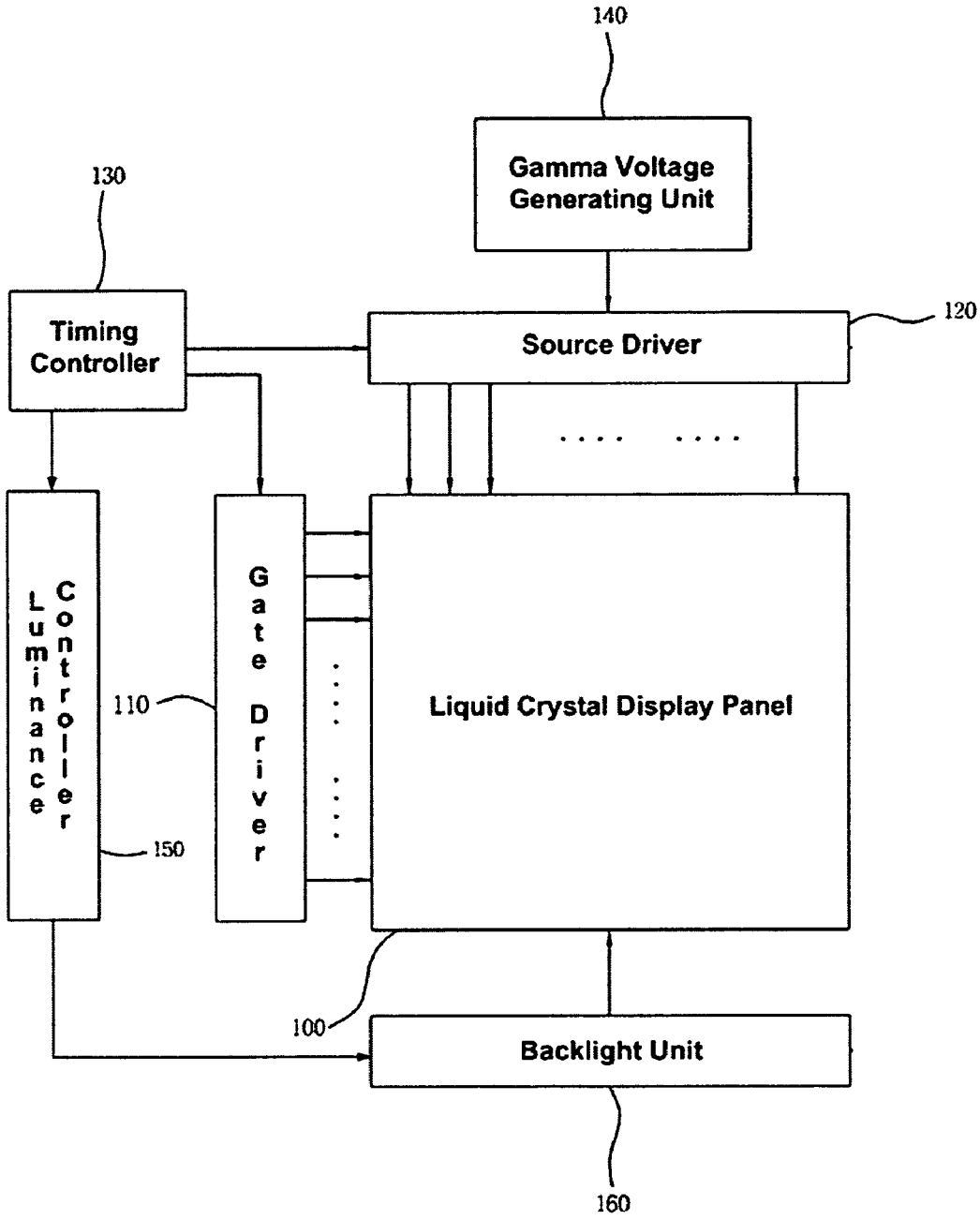
FIG. 12 is a block diagram showing an LCD according to another embodiment of the present invention.

Next, FIG. 12 is a block diagram showing of an LCD according to another embodiment of the present invention, which has a similar construction as that shown in FIG. 1, except the luminance controller 150 receives pixel data from the timing controller 130, and not from the source driver 120.

That is, the timing controller 130 supplies a timing control signal to the gate driver 110 and the source driver 120 and pixel data to the luminance controller 150. The luminance controller 150 receives the pixel data from the timing controller 130 and controls a current mechanically or electronically according to the received pixel data to control a luminance of the LED array 161 according to UAs. Likewise, when an arbitrary UA is set as a reference UA, pixel data of the reference UA is sensed and the LEDs 162 that belong to the reference UA among the LED array 161 are dimmed according to the pixel data. Further, the method for driving the LCD according to this embodiment is the same as the former embodiment, except that the luminance controller 150 receives pixel data from the timing controller 130, and not from the source driver 120 as described above. Thus, the LCD according to the embodiments of the present invention can drive the side radiation type LEDs suitably according to sectional driving and enhance the efficiency and the contrast ratio of the liquid crystal display panel.

Although the embodiment of the present invention have been shown and described with reference to the accompanying drawings, it would be appreciated by those skilled in the art that changes might be made in this embodiment without departing from the principles and spirit of the invention, the scope of which is defined in the claims and their equivalents. Therefore, the description proposed herein is just a preferable example for the purpose of illustrations only, not intended to limit the scope of the invention, so it should be understood that other equivalents and modifications could be made thereto without departing from the spirit and scope of the invention.

What is claimed is:

1. A liquid crystal display comprising:

a liquid crystal display panel including a plurality of gate and data lines arranged to cross each other, and a thin film transistor and a pixel electrode disposed at each crossing of the gate and data lines, and in which an image is displayed on the liquid crystal display panel according to scan signals supplied through the gate lines and analog pixel signals supplied through the data lines;

a gate driver for sequentially supplying the scan signals to the gate lines of the liquid crystal display panel;

a source driver for converting inputted pixel data into analog pixel signals and supplying the converted analog pixel signals to the data lines of the liquid crystal display panel;

a timing controller for supplying a timing control signal to the gate driver and the source driver and supplying the pixel data to the source driver;

a back light unit (BLU) including a side radiation type Light Emitting Diode (LED) array and being sectionally driven by a plurality of unit areas to irradiate light to the liquid crystal display panel; and a luminance controller for receiving the pixel data from the source driver, and controlling a luminance of the LED array by unit areas according to the pixel data, wherein the luminance controller controls the luminance of the LED array using a luminance contribution percentage including a ratio in which a luminance of adjacent unit areas that surround a reference unit area affects that of the reference unit area, wherein the luminance controller detects a brightest unit area among the reference unit area and the adjacent unit areas using the pixel data, and if the reference unit area is the brightest area, the luminance controller controls the reference unit area to have an average luminance of pixel data corresponding to the reference unit area, whereas if one or more of the adjacent unit areas is/are brighter than the reference unit area, the luminance controller calculates a correction luminance using a substantial luminance percentage including a ratio in which the luminance of the reference unit area is changed by the luminance of the adjacent unit areas and each luminance contribution percentage of the adjacent unit areas, and controls the reference unit area to have the calculated correction luminance, and wherein the correction luminance of the reference unit area is obtained by dividing a sum of a value obtained by multiplying the average luminance and the substantial luminance percentage of the reference unit area, and a value obtained by multiplying an average luminance and each luminance contribution percentage of the adjacent unit areas by the number of the adjacent unit areas.

2. The liquid crystal display of claim 1, wherein the correction luminance of the reference unit area is determined depending on each position and the number of the adjacent unit areas.

3. The liquid crystal display of claim 1, wherein the substantial luminance percentage of the reference unit area is obtained such that when the average luminance of the reference unit area is controlled to have a first luminance value and an average luminance of the adjacent unit areas is controlled to have a second luminance value, an extent that the average luminance of the reference unit area is changed is measured to be determined as the luminance contribution proportions of the adjacent unit areas, and the ratio of the first luminance value to the sum of the first luminance value and the total obtained by adding up the luminance contribution proportions of the adjacent unit areas is expressed as the percentage.

4. The liquid crystal display of claim 1, wherein each luminance contribution percentage of the adjacent unit areas is obtained such that when the average luminance of the reference unit area is controlled to have a first luminance value an average luminance of the adjacent unit areas is controlled to have a second luminance value, an extent that the average luminance of the reference unit area is changed is measured to be determined as the luminance contribution proportions of the adjacent unit areas, and the luminance contribution proportions of the adjacent unit areas to the sum of the first luminance value and the total obtained by adding up the luminance variation proportions of the adjacent unit areas are expressed as the percentage.

5. The liquid crystal display of claim 1, wherein the reference unit area comprises:

a type of reference unit area that comprises one adjacent unit area in the horizontal direction, one adjacent unit area in the vertical direction, and one adjacent unit area in the diagonal direction;

a type of reference unit area that comprises two adjacent unit areas in the horizontal direction, one adjacent unit area in the vertical direction, and two adjacent unit areas in the diagonal direction;

a type of reference unit area that comprises one adjacent unit area in the horizontal direction, two adjacent unit areas in the vertical direction, and two adjacent unit areas in the diagonal direction; and a type of reference unit area that comprises two adjacent unit areas in the horizontal direction, two adjacent unit areas in the vertical direction, and four adjacent unit areas in the diagonal direction.

6. A liquid crystal display comprising:

a liquid crystal display panel including a plurality of gate and data lines arranged to cross each other, and a thin film transistor and a pixel electrode are disposed at each crossing of the gate and data lines, and in which an image is displayed on the liquid crystal display panel according to scan signals supplied through the gate lines and analog pixel signals supplied through the data lines;

a gate driver for sequentially supplying the scan signals to the gate lines of the liquid crystal display panel;

a source driver for converting inputted pixel data into analog pixel signals and supplying the converted analog pixel signals to the data lines of the liquid crystal display panel;

a timing controller for supplying a timing control signal to the gate driver and the source driver and supplying the pixel data to a luminance controller and the source driver;

a back light unit (BLU) including a side radiation type Light Emitting Diode (LED) array and being sectionally driven by a plurality of unit areas to irradiate light to the liquid crystal display panel; and a luminance controller for receiving the pixel data from the timing controller and controlling a luminance of the LED array by unit areas according to the pixel data, wherein the luminance controller controls the luminance of the LED array using a luminance contribution percentage including a ratio in which a luminance of adjacent unit areas that surround a reference unit area affects that of the reference unit area, wherein the luminance controller detects a brightest unit area among the reference unit area and the adjacent unit areas using the pixel data, and if the reference unit area is the brightest area, the luminance controller controls the reference unit area to have an average luminance of pixel data corresponding to the reference unit area, whereas if one or more of the adjacent unit areas is/are brighter than the reference unit area, the luminance controller calculates a correction luminance using a substantial luminance percentage including a ratio in which the luminance of the reference unit area is changed by the luminance of the adjacent unit areas and each luminance contribution percentage of the adjacent unit areas, and controls the reference unit area to have the calculated correction luminance, and wherein the correction luminance of the reference unit area is obtained by dividing a sum of a value obtained by multiplying the average luminance and the substantial luminance percentage of the reference unit area, and a value obtained by multiplying an average luminance and each luminance contribution percentage of the adjacent unit areas by the number of the adjacent unit areas.

7. The liquid crystal display of claim 6, wherein the correction luminance of the reference unit area is determined depending on each position and the number of the adjacent unit areas.

8. A method for driving a liquid crystal display, the method comprising:

supplying, by a timing controller, a timing control signal to a gate and source driver and pixel data to the source driver;

sequentially supplying, by the gate driver, scan signals to gate lines of a liquid crystal display panel;

converting, by the source driver, the pixel data into analog pixel signals and outputting the signals to data lines of the liquid crystal display panel;

receiving, by a luminance controller, the pixel data from the source driver and controlling a side radiation type light emitting diode (LED) array provided in a backlight unit (BLU) by unit areas according to the pixel data; and irradiating light to the liquid crystal display panel by sectionally driving the BLU which is divided into a plurality of unit areas, wherein the luminance controller controls a luminance of the LED array using a luminance contribution percentage including a ratio in which a luminance of adjacent unit areas that surround a reference unit area affects that of the reference unit area, wherein the luminance controller detects a brightest unit area among the reference unit area and the adjacent unit areas using the pixel data, and if the reference unit area is the brightest area, the luminance controller controls the reference unit area to have an average luminance of pixel data corresponding to the reference unit area, whereas if one or more of the adjacent unit areas is/are brighter than the reference unit area, the luminance controller calculates a correction luminance using a substantial luminance percentage, including a ratio in which the luminance of the reference unit area is changed by the luminance of the adjacent unit areas and each luminance contribution percentage of the adjacent unit areas, and controls the reference unit area to have the calculated correction luminance, and wherein the correction luminance of the reference unit area is obtained by dividing a sum of a value obtained by multiplying the average luminance and the substantial luminance percentage of the reference unit area, and a value obtained by multiplying an average luminance and each luminance contribution percentage of the adjacent unit areas by the number of the adjacent unit areas.

9. The method of claim 8, wherein the correction luminance of the reference unit area is determined depending on each position and the number of the adjacent unit areas.

10. The method of claim 8, wherein substantial luminance percentage of the reference unit area is obtained such that when the average luminance of the reference unit area is controlled to have a first luminance value an average luminance of the adjacent unit areas is controlled to have a second luminance value, an extent that the average luminance of the reference unit area is changed is measured to be determined as the luminance contribution proportions of the adjacent unit areas, and the ratio of the first luminance value to the sum of the first luminance value and the total obtained by adding up the luminance contribution proportions of the adjacent unit areas is expressed as the percentage.

11. The method of claim 8, wherein the luminance contribution percentages of the adjacent unit areas are obtained such that when the average luminance of the reference unit area is controlled to have a first luminance value and an average luminance of the adjacent unit areas is controlled to have a second luminance value, an extent that the average luminance of the reference unit area is changed is measured to be determined as the luminance contribution proportions of the adjacent unit areas, and the luminance contribution proportions of the adjacent unit areas to the sum of the first luminance value and the total obtained by adding up the luminance variation proportions of the adjacent unit areas are expressed as the percentage.

12. The method of claim 8, wherein the reference unit area comprises:

a type of reference unit area that comprises one adjacent unit area in the horizontal direction, one adjacent unit area in the vertical direction, and one adjacent unit area in the diagonal direction;

a type of reference unit area that comprises two adjacent unit areas in the horizontal direction, one adjacent unit area in the vertical direction, and two adjacent unit areas in the diagonal direction;

a type of reference unit area that comprises one adjacent unit area in the horizontal direction, two adjacent unit areas in the vertical direction, and two adjacent unit areas in the diagonal direction; and a type of reference unit area that comprises two adjacent unit areas in the horizontal direction, two adjacent unit areas in the vertical direction, and four adjacent unit areas in the diagonal direction.

13. A method for driving a liquid crystal display, the method comprising:

supplying, by a timing controller, a timing control signal to a gate and source driver and pixel data to a luminance controller and the source driver;

sequentially supplying, by the gate driver, scan signals to gate lines of a liquid crystal display panel;

converting, by the source driver, the pixel data into analog pixel signals and outputting the signals to data lines of the liquid crystal display panel;

receiving, by the luminance controller, the pixel data from the timing controller and controlling a side radiation type light emitting diode (LED) array provided in a backlight unit (BLU) by unit areas according to the pixel data; and irradiating light to the liquid crystal display panel by sectionally driving the BLU which is divided into a plurality of unit areas, wherein the luminance controller controls the luminance of the LED array using a luminance contribution percentage including a ratio in which a luminance of adjacent unit areas that surround the reference unit area affects that of the reference unit area, wherein the luminance controller detects a brightest unit area among the reference unit area and the adjacent unit areas using the pixel data, and if the reference unit area is the brightest area, the luminance controller controls the reference unit area to have an average luminance of pixel data corresponding to the reference unit area, whereas if one or more of the adjacent unit areas is/are brighter than the reference unit area, the luminance controller calculates a correction luminance using a substantial luminance percentage including a ratio in which the luminance of the reference unit area is changed by the luminance of the adjacent unit areas and each luminance contribution percentage of the adjacent unit areas, and controls the reference unit area to have the calculated correction luminance, and wherein the correction luminance of the reference unit area is obtained by dividing a sum of a value obtained by multiplying the average luminance and the substantial luminance percentage of the reference unit area, and a value obtained by multiplying an average luminance and each luminance contribution percentage of the adjacent unit areas by the number of the adjacent unit areas.

14. The method of claim 13, wherein the correction luminance of the reference unit area is determined depending on each position and the number of the adjacent unit areas.

* * * * *